United States Patent [19]

Bloch

[11] 4,324,103

[45] * Apr. 13, 1982

[54] METHOD AND APPARATUS FOR REGULATING A STEAM TURBINE

[75] Inventor: Heinz Bloch, Nussbaumen, Switzerland

[73] Assignee: BBC Brown, Boveri & Company Limited, Baden, Switzerland

[ * ] Notice: The portion of the term of this patent subsequent to Jan. 22, 1997, has been disclaimed.

[21] Appl. No.: 5,290

[22] Filed: Jan. 22, 1979

[30] Foreign Application Priority Data

Jan. 31, 1978 [CH] Switzerland ..... 1014/78
Feb. 17, 1978 [CH] Switzerland ..... 1759/78

[51] Int. Cl.[3] ..... F01K 13/02
[52] U.S. Cl. ..... 60/663; 60/660
[58] Field of Search ..... 60/660, 663; 415/17, 415/30

[56] References Cited

U.S. PATENT DOCUMENTS 3,097,490 7/1963 Callan et al. ..... 60/663 X
4,184,337 1/1980 Bloch ..... 60/660

*Primary Examiner*—Allen M. Ostrager
*Attorney, Agent, or Firm*—Werner W. Kleeman

[57] ABSTRACT

A method and apparatus for regulating a steam turbine comprising at least one resuperheater arranged between a high pressure section and a low pressure section and in which a reference-actual valve comparison of the rotational speed is performed to produce an adjustment signal derived from the reference-value actual-value difference which is delivered to a regulation valve arrangement and wherein a delayed feedback signal is derived from only one vapor pressure high pressure side measuring pressure, between the inlet valves of the high pressure section and the inlet of the resuperheater, and which at least approximately decreases to null during steady-state operation; and said signal is coupled into the regulation circuit opposite to the adjustment signal.

8 Claims, 3 Drawing Figures

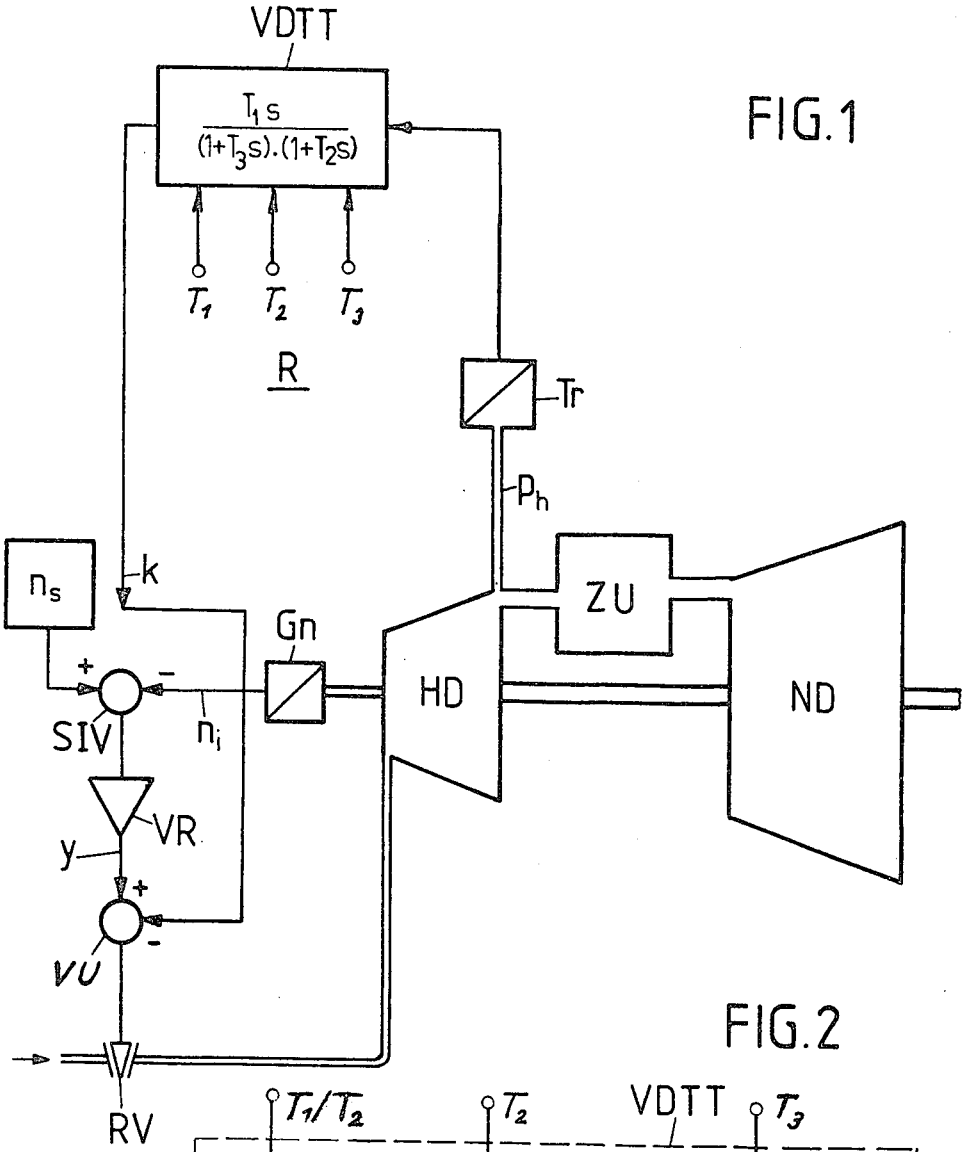
FIG.1
FIG.2
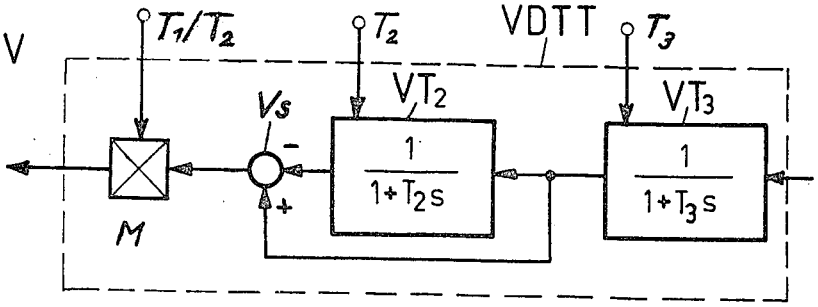

METHOD AND APPARATUS FOR REGULATING A STEAM TURBINE

CROSS-REFERENCE TO RELATED APPLICATIONS

Application Ser. No. 6,476, filed Jan. 24, 1979, and U.S. Pat. No. 4,184,337 granted Jan. 22, 1980, contain subject matter related to this application, and are commonly assigned herewith.

BACKGROUND OF THE INVENTION

The invention relates to a method of regulating a steam turbine comprising at least one resuperheater arranged between a high pressure section and a low pressure section, wherein there is carried out a reference value-actual value comparison of the rotational speed and an adjustment magnitude derived from the reference value-actual value difference is delivered to a regulation valve arrangement. Further subject matter of the invention pertains to an apparatus for the performance of such method.

Steam turbine regulation encompasses a rotational speed regulation generally in the form of a direct rotational speed regulation with an essentially simple closed regulation circuit or in the form of a rotational speed regulation or frequency-output regulation, for instance, as an output regulation circuit having a subordinated rotational speed regulation circuit. In both instances there is carried out a reference value-actual value comparison of the rotational speed and there is derived, directly or indirectly, an adjustment magnitude from the reference value-actual value difference. For the stability and quality of the regulation, i.e., for a rapid and oscillation-free transition between different, steady state operating conditions following the occurrence of surge-like disturbances, for instance, due to load surges at the power supply network of an electrical generator coupled with the turbine, there is required an optimization of the transition behavior of the regulation circuit with appropriate damping. For this optimization there are available for complex regulation circuits different transmission elements having adjustable or selectable parameters, which, however, are associated with comparatively high circuit expenditure. Particularly in the case of installations using mechanical or hydraulic, proportional-functioning rotational speed regulation, the attainment of rapid and oscillation-free rotational speed-transition behavior can cause difficulties. This is especially true in the case of turbine-generator units which work both in the so-called island mode of operation and also in compound operation.

SUMMARY AND OBJECTS OF THE INVENTION

Therefore, it is the objective of the invention to provide a regulation method and an appriopriate apparatus, by means of which there can be obtained an advantageous rotational speed-transition behavior with comparatively low expenditure in regulation equipment, and specifically, especially for simple proportional-rotational speed regulation, for instance for turbines working in island and compound operation. The inventive solution of such objective, with a method of the previously mentioned type, is characterized by the features of the subject invention.

With a change of the adjustment magnitude caused by a disturbance, for instance a load surge, the thus produced feedback magnitude functions in the manner of a negative feedback, thus basically reduces the corresponding change in the adjustment magnitude, however with a time-delay corresponding to the flow inertia of the resuperheater, i.e., in accordance with the time-delay time-constants constants of the pressure transmission by the resuperheater, briefly referred to as "resuperheater time-constant". Owing to this inertia the pressure at the output of the resuperheater reacts with a time-delay time-constant in the order of magnitude of several seconds upon an inlet side pressure change, i.e., essentially to an adjustment of the inlet valve of the preceding high pressure section of the turbine. The high pressure side measuring pressure follows with only slight time-delay the action of the regulation valve arrangement under the effect of the adjustment magnitude. The stabilizing action of the feedback therefore, roughly speaking, can be explained in terms that there is generally preferred the flow inertia of the resuperheater, and thus, the delayed reaction of the rotational moment component of the subsequent low pressure section, which can lead to overshooting and possibly instability. This delayed reaction of the regulation loop can be more or less compensated by the available negative feedback, and the amplitude of the feedback magnitude, which decreases to null, avoids an additional static component, and thus, an additional stationary regulation error.

Basically, a steam pressure at the region between the inlet valves of the high pressure section and the inlet of the resuperheater can be used for the formation of the feedback magnitude, because the delays in the transition behavior of the steam pressure at such region are negligibly small for the present purposes. The measuring location need only be selected such that there is insured a stable, quasi-static pressure distribution. There is preferably used the impeller casing pressure of the high pressure section, because for such there is generally present any way a measuring location, and therefore, there does not arise any additional expenditure.

Static pressure differences between the different measuring locations which come under consideration for the high pressure side measuring pressure are without any influence when they are conventionally standardized to a rated value. Such standardization will be hereinafter presupposed for all of the employed measuring pressures, without any particular explanation or separate showing being made.

As concerns the apparatus for the performance of the regulation method the subject matter of the invention encompasses a solution.

Thereafter, the transition behavior, decreasing to null, of the feedback magnitude can be realized in a simple manner by means of a differentiating transmission element or by a grouped together transmission element having a transfer function and possessing an appropriate D-behavior. Furthermore, the time-delay behavior, conventionally referred to in publications also as the T-behavior, is set such that the flow inertia in the pressure transmission of the resuperheater is more or less extensively simulated, and furthermore, there is produced a time-delay of the thus simulated resuperheater pressure in accordance with the strived for stabilization effect. Such apparatus is manifested by the comparatively low equipment expenditure and high operational reliability.

BRIEF DESCRIPTION OF THE DRAWINGS

Further features and advantages of the invention will be explained on the basis of the schematically illustrated embodiments of the drawings, in which FIG. 1 is a functional diagram of a steam turbine regulation having high pressure section, resuperheater, low pressure section and rotational speed regulation circuit as well as feedback of a magnitude in the regulation circuit and which is derived from the high pressure side measuring pressure, FIG. 2 illustrates a modified part of the circuitry of the arrangement of FIG. 1.

DETAILED DESCRIPTION OF THE PREFERRED EMBODIMENT

Figure 3:
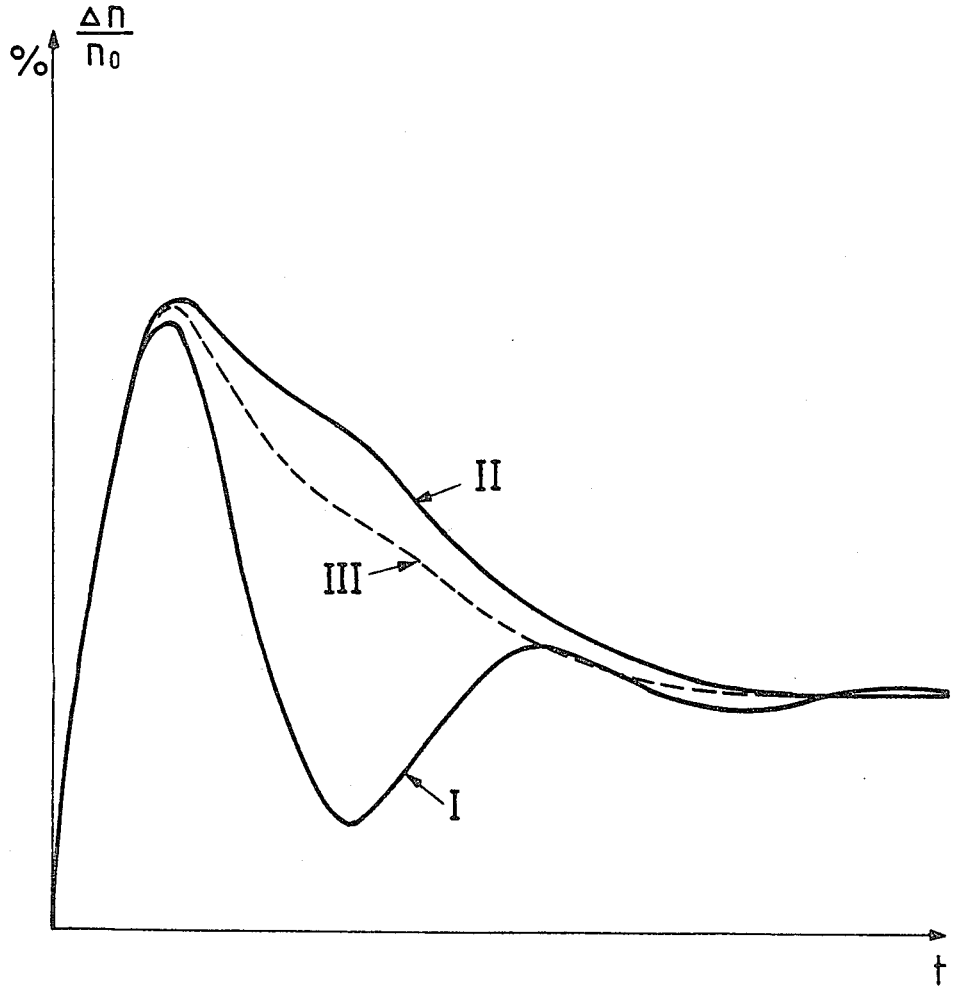
FIG. 3 is a graph which plots the rotational speed change $\Delta n$, related to the rated rotational speed $n_o$, as a function of time as the response to a surge-like reduction of the turbine output (negative load surge).

The turbine indicated in FIG. 1 comprises a high pressure stage HD, supplied by a regulation valve arrangement RV, and provided with a subsequently arranged resuperheater ZU and low pressure stage ND fed by the latter. Connected with the turbine as the regulation path is a tachogenerator Gn serving as a measuring element, which converts the rotational speed of the turbine into an appropriate actual value signal $n_i$. The latter is subtractively superimposed upon a reference value signal $n_s$ delivered by an appropriate transmitter, in a superimposing element SIV functioning as a reference value-actual value comparator. The thus resulting reference value-actual value difference, in the case of the illustrated, simple proportional regulation, is converted in a regulation amplifier VR into an adjustment magnitude y, which by means of a not further illustrated, for instance, electrohydraulic transducer, controls the drive of the regulation valve arrangement RV.

Such rotational speed-regulation circuit, with a negative load surge, typically produces an equalization operation, as such has been indicated in FIG. 3 by the curve I. The rotational speed change $\Delta n/n_o$, related to the rated rotational speed $n_o$, following pronounced oscillations, which typically last for a time span of about 15 seconds, transforms into an essentially steady state value governed by the statics of the regulation circuit. The maximum overshoot amplitude of $\Delta n/n_o$ approximately attains the 2.5-fold value of the steady state rotational speed change. Such type transition behavior is particularly undesired or, in fact, impermissible for the island operation of a larger turbo-generator unit in consideration of the frequency fluctuations in the load network.

In the description to follow there will be presupposed, without further discussion, the standardization of the measuring pressures.

To optimize damping, in FIG. 1 there is contemplated the feedback of a magnitude derived from a high pressure side measuring pressure $p_h$, here from the impeller casing pressure of the high pressure section HD by means of a pressure-measuring transducer Tr, in the regulation circuit with opposite effect to the adjustment magnitude. In the feedback branch R of the circuit which is constructed for this purpose, the output signal of the transducer Tr is converted by means of a transmission circuit VDTT into a feedback magnitude k, which is connected with an output of an additional, subtractive superimposing element VU in the output circuit of the regulation amplifier VR, and which input functions opposite to the polarity of the reference value signal $n_s$, and thus, opposite to the polarity of the adjustment magnitude y.

The transfer function of the transmission circuit VDTT is of the type $T_1 \cdot s/(1+T_2 \cdot s) \cdot (1+T_3 \cdot s)$, wherein s is the Laplace operator and $T_1$ the time constant of the D-component, the differentiating numerator of the transfer function. This D-component causes a transition behavior of the feedback magnitude k and which yields to null, whereby there is avoided a static error or an additionally remaining regulation deviation. The D-time-constant $T_1$ is generally set at least approximately to correspond to the resuperheater time-constants. The transfer function additionally possesses a time-delay behavior (T-behavior) of the second order corresponding to the indicated denominator with both of the time-constants $T_2$ and $T_3$. One of these time-constants, for instance $T_3$, is set in accordance with a simulation of the flow inertia and thus the delay in the pressure transmission of the resuperheater, whereas the other time-constant, in other words $T_2$, is set to a value corresponding at least to the resuperheater time-constants, for instance to a larger value, in order to realize the strived for stabilization and oscillation damping in the transition behavior of the regulation circuit. The time-constants $T_1$, $T_2$ and $T_3$ are adjustable as operating parameters at corresponding inputs of the transmission circuit VDTT, as such has been indicated in FIG. 1.

FIG. 2 illustrates a more simply realizable construction of the transmission circuit VDTT while utilizing two simple delay elements $VT_2$ and $VT_3$ with the transfer function $1/(1+T_2 \cdot s)$ and $1/(1+T_3 \cdot s)$. The time-constants $T_2$ and $T_3$ are set at related inputs. Both of the time-delay elements are connected in series, and for the realization of the yielding transition behavior there is appropriately produced a D-component by subtractive superimposing of the output signal of $VT_3$ with the output of $VT_2$ in a superimposing element Vs. Calculations show that in this way there is obtained a transfer function having D-behavior of the first order as well as T-behavior of the second order, as indicated further above. For the adjustment of the D-time-constants $T_1$ and the proportional amplification in the feedback branch and which determines the constant numerator factor of the transfer function, there is arranged after the output of the superimposing element Vs a multiplier M having an amplification-control input for $T_1$.

Curve II of FIG. 3 shows the effect of the feedback branch for the following parameter settings: amplification factor $g=0.5$, time-constant $T=$resuperheater time-constant. There will be apparent therefrom an appreciable improvement in the transition behavior while practically completely avoiding oscillations, and specifically, remarkably worthy of mention, practically without any delay of the maximum rotational speed elevation in comparison to the maximum overshoot amplitude of the curve I. A still more extensive optimization of the parameter setting with $g=1.5$ and again $T=$resuperheater time-constant, is shown by curve III, which not only is free of oscillations, but also merges appreciably earlier than the curve II into the new steady state rotational speed value, and thus, corresponds approximately to the strived for ideal case of aperiodic damping. Thus, there are to be preferred amplification values in a range between 1 and 2. Tests which are not here further explained have produced the result that the time-delay time-constant T should not fall below the resuperheater time-constant, rather more likely should exceed such.

Although only a preferred embodiment is specifically illustrated and described herein, it will be appreciated that many modifications and variations of the present invention are possible in light of the above teachings and within the purview of the appended claims without departing from the spirit and intended scope of the invention.

I claim:

1. A method of regulating a steam turbine, comprising the steps of:

arranging at least one resuperheater between a high pressure section and a low pressure section;

comparing a reference value and an actual value of the rotational speed of the steam turbine at said resuperheater;

deriving a difference from the comparing of the reference value and the actual value;

providing an adjustment signal from said differences;

delivering the adjustment signal to a regulation valve arrangement of a regulation circuit;

measuring only one vapor pressure between an inlet valve of the high pressure section and an inlet of the resuperheater;

deriving from the measured vapor pressure a delayed feedback signal which at least approximately decreases to zero during steady state operation; and coupling the feedback signal into the regulation circuit in opposition to the adjustment signal.

2. The method, according to claim 1, further comprising the step of:

deriving the feedback signal from an impeller casing pressure of the high pressure section.

3. An apparatus for regulating a steam turbine, comprising:

at least one resuperheater arranged between a high pressure section and a low pressure section;

means for comparing a reference value and an actual value of the rotational speed of the steam turbine;

means for deriving a difference from the comparing of the reference value and the actual value;

means for producing an adjustment signal from said difference;

a regulation circuit having a regulation valve arrangement and a superimposing element therein;

means for delivering the adjustment signal to the regulation valve arrangement;

transducer means for measuring pressure at the high pressure section;

transmission circuit means for connecting an output of the transducer means with an input of the superimposing element;

wherein said input functions in opposition to the adjustment signal in the regulation circuit; and wherein said transmission circuit means has a transfer function which possesses a differential component and a time-delay component.

4. The apparatus according to claim 3, wherein:

said differential component of the transfer function of said transmission circuit means is of a first order having a differential time-constant which is at least approximately equal to a time-constant for the resuperheater.

5. The apparatus, according to claim 3, wherein;

said time-delay component of the transfer function of said transmission circuit means is of at least a second order having a first and a second time-delay time-constant.

6. The apparatus, according to claim 5, wherein:

said first time-delay time-constant of said time-delay component is at least approximately equal to a time-constant for the resuperheater.

7. The apparatus, according to claim 5, wherein:

said second time-delay time-constant of said time-delay component is dimensioned at least approximately in accordance with time-delay behavior of pressure transmission inside the resuperheater.

8. The apparatus, according to claim 3, further comprising:

two series-connected time-delay elements being arranged in said transmission circuit means;

a subtractive superimposing element having two mutually opposite inputs and an output coupled into the regulation circuit in opposition to the adjustment signal; and means for connecting outputs of the two time-delay elements with one of the two mutually opposite inputs of said substractive superimposing element.

* * * * *